United States Patent [19]

Donovan

[11] 4,030,219

[45] June 21, 1977

[54] PORTABLE DISPLAY APPARATUS

[75] Inventor: John E. Donovan, Skokie, Ill.

[73] Assignee: Package Exhibit Programs, Inc., Niles, Ill.

[22] Filed: June 1, 1976

[21] Appl. No.: 688,821

[52] U.S. Cl. ..... 40/130 R; 40/125 H; 160/135; 211/195

[51] Int. Cl.² ..... G09F 13/00

[58] Field of Search ..... 40/125 H, 130 R, 125 K, 40/125 R, 125 F; 211/198, 195, 189; 160/135, 351; 350/126; 353/74, 71

[56] References Cited

UNITED STATES PATENTS

| | | | |
|---|---|---|---|
| 2,587,698 | 3/1952 | Corn et al. | 211/189 |
| 3,682,530 | 8/1972 | De Palma et al. | 350/126 |
| 3,817,396 | 6/1974 | Markson | 40/125 H X |
| 3,852,901 | 12/1974 | Woodle | 40/125 H |

*Primary Examiner*—John F. Pitrelli
*Attorney, Agent, or Firm*—Anthony S. Zummer

[57] ABSTRACT

A portable display apparatus is herein disclosed. The portable display apparatus is composed of a plurality of rectangular skeletal frames. Each rectangular skeletal frame of said plurality includes a horizontal hinge, adapted to enable said frame to fold vertically. Each rectangular skeletal frame of said plurality is identical to all other rectangular skeletal frames of said plurality. Each of said frames includes a plurality of opposite vertical members. Each of said vertical members is identical to all other vertical members. Each of said vertical members has a connector portion, and a track portion. Each of said rectangular skeletal frames is adapted to be bolted to other rectangular skeletal frames in either a fixed or pivotal relationship at the connector portions of the vertical members. Each of the rectangular skeletal frames is also adapted to be hingedly connected to the other rectangular skeletal frames. The track portions are adapted to receive a display panel within track portions. The track portions are positioned so that the connector portions do not interfere with the track portions or display panels.

1 Claim, 12 Drawing Figures

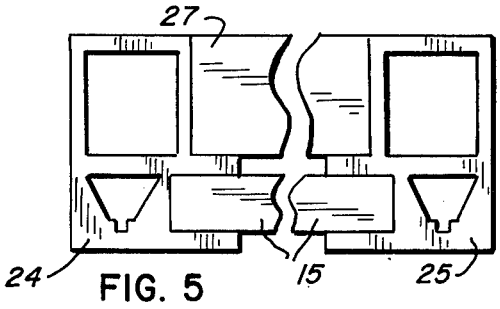
FIG. 5
FIG. 7
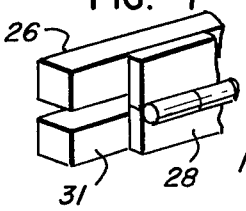
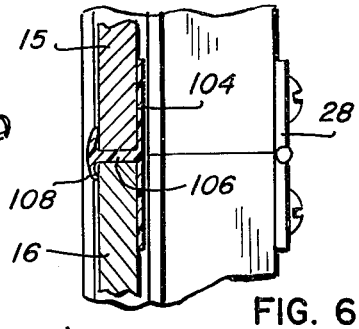
FIG. 6
FIG. 2
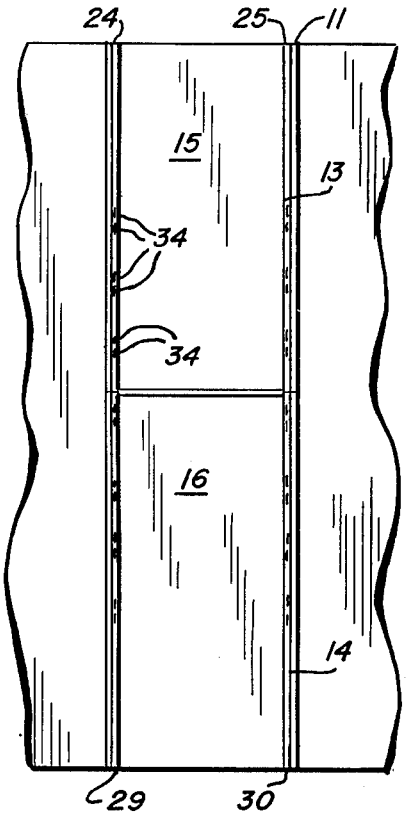
FIG. 3
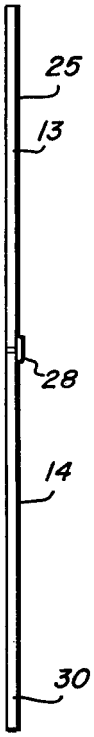
FIG. 4
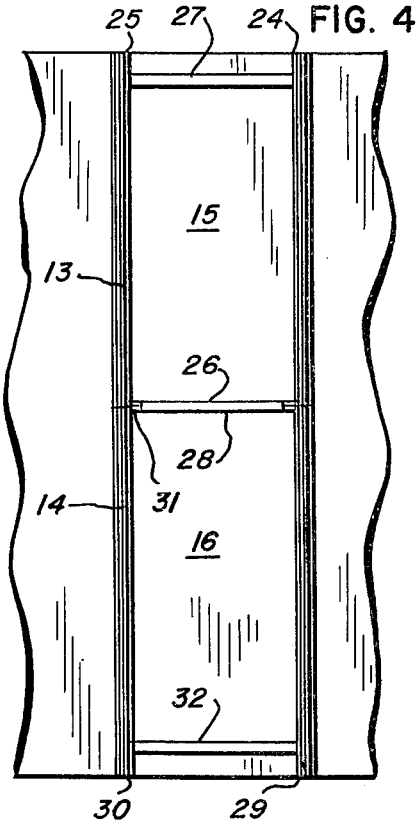
FIG. 8
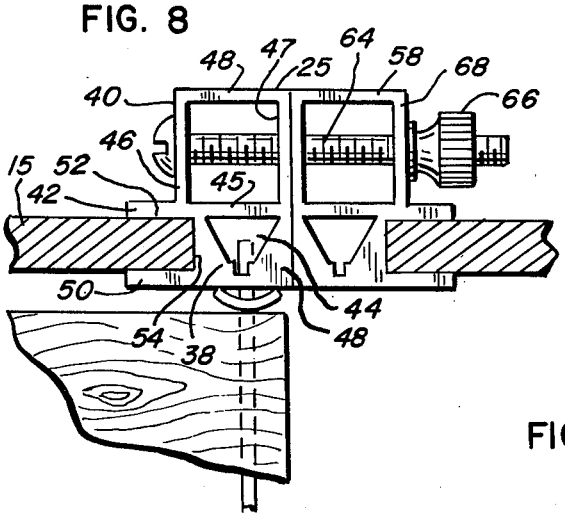
FIG. 9
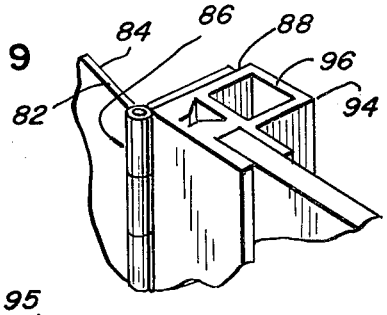
FIG. 10
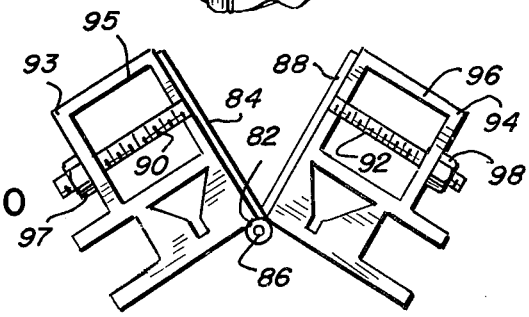

PORTABLE DISPLAY APPARATUS

BACKGROUND OF THE INVENTION

A portable display apparatus is a device which is old in the art. The portable display apparatus is, nevertheless, convenient for quickly and easily transporting and setting up exhibits at convention or display sites. These portable display devices usually consist of a skeletal framework, which is adapted to receive a plurality of sliding panels. The sliding panels have information upon them, which is to be communicated by the exhibitor to the persons touring the exhibit.

Older models of the typical display apparatus are usually assembled with display units positioned in a single plane. This constraint on assembly, of course, limits the most efficient utilization of limited exhibit space. Furthermore, if a conventional display apparatus was to be assembled with a frame member at right angles to one of the frame members, it was difficult to connect the two frame members together without having to disturb one of the display panels held in the frame.

The prior art also discloses an apparatus for hanging a light fixture from a typical display frame, which entails the use of a pair of brackets, a long bar and a light fixture hanging from the bar. The large number of parts needed to hang a single light fixture is undesirable for compact storage and easy transportation and set-up.

Therefore, what is needed is a portable display apparatus, having a plurality of display frames which can be hingedly connected together to assume a variety of angular displacements from each other. What is also needed is a combination right-angle and parallel connector, which is adapted to connect adjacent display frames together without the necessity of interfering with the track portions of adjacent display frames. What is also needed is a light fixture which may be quickly and easily connected to the erected display frame with a minimum of labor and parts.

SUMMARY OF THE INVENTION

A portable display apparatus, consisting of a plurality of connected rectangular skeletal display frames, is disclosed herein. Each of the rectangular skeletal display frames has a central hinge, allowing an upper portion of the display frame to be folded into contact with a lower portion of the display frame. The upper portion and lower portion are identical rectangles. When thus folded together, the display frames present a compact configuration, which may be easily shipped and stored in a minimum amount of space. Each of the display frames, when opened up, opens to a height of eight feet and a width of two feet. Each of the display frames also has a plurality of identical uprights, which have track portions and connector portions formed integral therewith. The track portions receive a pair of display panels slideably. Each of the track portions is approximately ¼ inch in width; and is adapted to receive a ¼ inch thick display panel. If thinner display panels are desired to be used, a panel stop may be rested on top of a lower panel to prevent an upper panel from sliding into contact with the lower panel. The connector portions, formed integral with the track portions, are offset from the track portions to allow the frames to be connected parallel, or perpendicular, to each other without interfering with the panels within the panel tracks.

The display frame also includes a light fixture, having a single extension arm which is adapted to be inserted into an upright connector portion adjacent to one of the track portions. Also included with the display frame is a hinged construction, which is connectable between each of a pair of the adjacent display frames to allow the adjacent display frames to be positioned at a plurality of angular orientations with respect to each other.

In use, the portable display apparatus is carried in a folded configuration within a single trunk. The trunk is approximately five feet high and two feet wide. Upon arrival at an exhibit site, the skeletal display frames are removed from the trunk; unfolded; and connected together via their side connectors or via the hinged connectors which can be connected between the side connectors. After the display frames are set up, a plurality of display panels are inserted into the track portions of the lower parts of the display frames. A panel stop is rested on top of each of the lower display panels. Upper display panels are then inserted into panel tracks in the upper portions of the display frames; and rested on the panel stops. The panel stops prevent the upper panels from sliding into the panel tracks, together with the lower panels. The extension arms of the light fixtures are inserted into a connector portion of an upright of the skeletal frame, immediately adjacent the track portion.

It is a principal object of the present invention to provide a portable display apparatus, having a plurality of upright connectors which are connectable in either a perpendicular or a parallel fashion and which have a plurality of connecting elements which do not intersect a display panel carried in the upright connector.

It is another object of the instant invention to provide a portable display apparatus, having a plurality of upright connectors which are extruded from anodized aluminum.

Other objects and uses of the present invention will become obvious to one skilled in the art upon a perusal of the following specification and claims in light of the accompanying drawings.

BRIEF DESCRIPTION OF THE DRAWINGS

FIG. 2 is a front view of a single frame unit of the display apparatus of FIG. 1;

FIG. 3 is a side view of the single frame unit of FIG. 2;

FIG. 4 is a back view of the single frame unit of FIG. 2;

FIG. 5 is a top view of the single frame unit of FIG. 2, having a portion broken away;

FIG. 6 is a side view of a portion of a track of the frame unit of FIG. 2, including a panel stop engaging a pair of display panels;

FIG. 7 is a perspective view of a pair of uprights and an elongated hinge, connecting the uprights together, having portions broken away;

FIG. 8 is a top enlarged view of a pair of uprights, shown in FIG. 2;

FIG. 9 is a perspective view, having portions broken away, of a hinge in engagement with an upright;

FIG. 10 is a top view of a pair of uprights, in engagement with the hinge of FIG. 9;

DESCRIPTION OF THE PREFERRED EMBODIMENT

Figure 1:
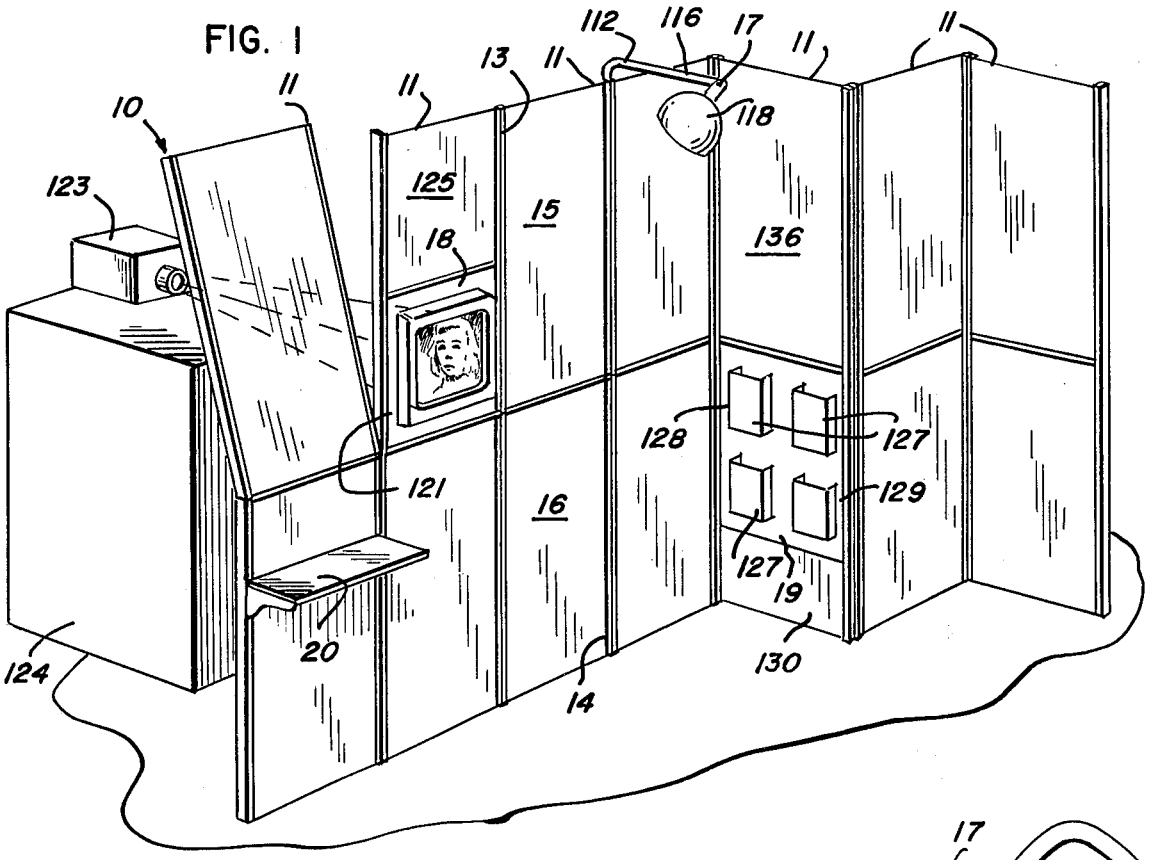
FIG. 1 is a perspective view of an assembled display apparatus, embodying the instant invention.

Referring now to the drawings, and especially to FIG. 1, a portable display apparatus, generally embodying the present invention and indicated by numeral 10, is shown therein. Portable display apparatus 10 includes a plurality of articulated rectangular skeletal frames 11. Articulated rectangular skeletal frame 11 includes an upper rectangular skeleton 13, and a lower rectangular skeleton 14. Upper rectangular skeleton 13 and lower rectangular skeleton 14 are connected hingedly together. An upper display panel 15 is mounted slideably within upper rectangular skeleton 13. A lower display panel 16 is slideably mounted within lower rectangular skeleton 14. A spot lamp 17 is connected to one of frames 11. A view screen 18 is slideably mounted within one frames 11. A literature holder 19 is slideably mounted within one of frames 11. A shelf 20 is mounted on one of frames 11.

Referring now to FIGS. 2, 3 and 4, articulated skeletal frame 11 is shown therein. All other frames 11 of the plurality are identical to frame 11. Upper rectangular skeleton 13 of frame 1 has a pair of top uprights 24 and 25. Top uprights 24 and 25 are four feet in length. A hinge crossbar 26, and an upper crossbar 27, are connected to uprights 24 and 25 at right angles to uprights 24 and 25. Hinge crossbar 26 is screwed to an elongated hinge 28.

Lower rectangular skeleton 14 of frame 11 includes a pair of bottom uprights 29 and 30. A hinge crossbar 31, and a lower crossbar 32, are connected to bottom uprights 29 and 30 at right angles to bottom uprights 29 and 30. Bottom uprights 29 and 30 are also positioned parallel to each other; are four feet in length; and are separated by a distance of two feet. Hinge crossbar 31 is connected to elongated hinge 28. Top uprights 24 and 25 can be folded into contact with bottom uprights 29 and 30, respectively, by folding skeletal frame 11 around elongated hinge 28. Upright 25 has a plurality of shelf slots 34.

Taking upright 25 as the exemplary upright, as shown in FIG. 8, it may be seen that upright 25 is composed of three integral units. A support section 38 is the first unit. A rectangular connector portion 40 is formed integral with support section 38. A track portion 42 is formed integral with support section 38; and is offset from rectangular connector portion 40.

Support section 38 has a trapezoidally-shaped channel 44 formed therein. Trapezoidally-shaped channel 44 terminates in a transverse wall 45 of rectangular connector portion 40. A pair of longitudinal walls, respectively numbered 46 and 47, is formed integral with, and perpendicular to, transverse wall 45. A transverse wall 48 is formed integral with, and perpendicular to, longitudinal walls 47 and 47, opposite transverse wall 45.

Track portion 42 includes a pair of panel tongues, respectively numbered 50 and 52 and extending perpendicularly from longitudinal wall 46 and trapezoidal channel 44. Tongues 50 and 52 terminate in a common slide base 54. Uprights 24, 29 and 30 are identical in configuration to the exemplary upright 25. Upright 25, like all the other uprights, is a single extruded part. Upright 25 is quickly and easily manufactured by extrusion.

As is shown in FIG. 7, upright 25 is connected to an upright 58, side by side, so that their respective track portions are oriented parallel or coplanar. A connecting bolt 64, having a knurled nut 66 threadedly attached thereto, penetrates through rectangular connector 40 of upright 25 and a rectangular connector 68 of upright 58, parallel to the track portions. It should be noted that the track portions of the uprights are not interfered with by connecting bolt 64.

Figure 12:
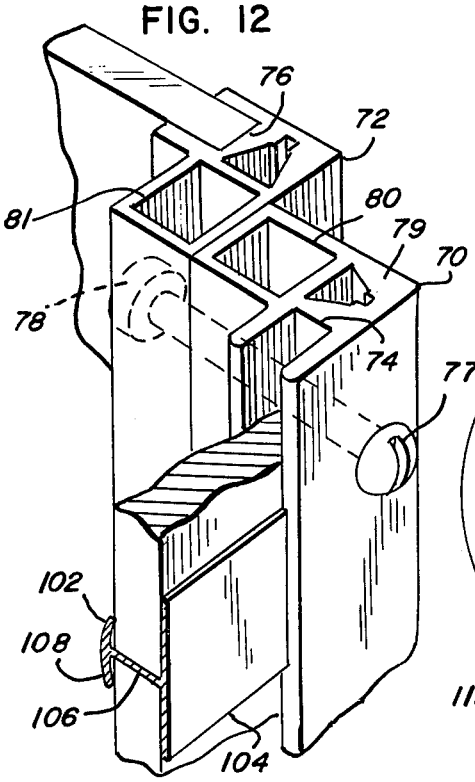
FIG. 12 is a perspective view, having portions broken away, showing details of the connection between a pair of uprights positioned at right angles to each other.
Figure 11:
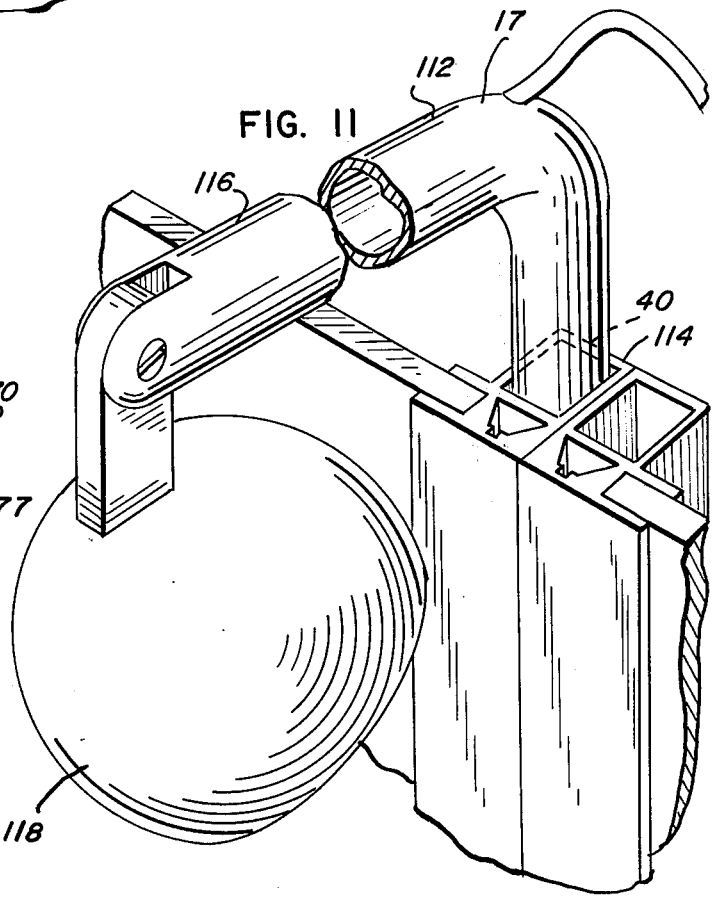
FIG. 11 is a perspective view of a lamp, having a portion broken away, in mounting connection with an upright of the display unit of FIG. 1.

Referring now to FIG. 12, an alternative connection is shown therein. A pair of uprights, numbered 70 and 72 (each having a respective track portion 74 and 76), is connected in such a fashion that track portions 74 and 76 are positioned at right angles. A connecting bolt 77, having a knurled nut 78 threadedly attached thereto, penetrates through a support portion 79 and a rectangular channel 80 of upright 70; and a rectangular channel 81 of upright 72, parallel to track portion 76 and perpendicular to track portion 74. In both FIGS. 8 and 12, it should be noted that the respective connecting bolts and nuts do not interfere with the track portions of the uprights.

The various skeletal frames 11 of the plurality can also be connected at a variety of angles by using a hinge 82, as is shown in FIGS. 8 and 9. Hinge 82 includes a first hinge leaf 84; a central hinge pin 86, connected to first hinge leaf 84; and a second hinge leaf 88, connected to hinge pin 86. A pair of threaded rods, respectively numbered 90 and 92, is brazed respectively to hinge plates 84 and 88. Hinge 82 is connected to a pair of uprights, respectively numbered 93 and 94 and having a pair of respective rectangular channels (numbered 95 and 96) by placing threaded rods 90 and 92 through a plurality of apertures formed therein. After threaded rods 90 and 92 pass through a far wall of the rectangles, a pair of knurled nuts 97 and 98 is respectively threaded onto threaded rods 90 and 92.

After the frames 11 are thus assembled, a plurality of display panels, having information thereon (exemplified by display panels 15 and 16), can be slid into the track portions of the uprights. A conventional panel thickness is ¼ of an inch. The distance between tongues 50 and 52 of exemplary upright 25 is slightly greater than ¼ of an inch to allow the display panels to slide freely. It may be appreciated that, if display panels having a thickness of ⅛ of an inch are used, upper panel 15 can slide past lower panel 16; and, thus, both panels drop between lower uprights 29 and 30.

In order to prevent this, a panel stop 102 (as is shown in FIG. 6) is laid across an upper portion of panel 16. Panel stop 102 includes a flat backstop 104; a crossbar 106, formed integral with, and perpendicular to, backstop 104; and a curved retainer 108, formed integral with, and perpendicular to, crossbar 106. After panel stop 102 is thus resting on panel 16, panel 15 can be dropped into contact with crossbar 106 of panel stop 102. Thus, panel 15 does not slide behind, or in front of, panel 16.

A spot lamp 17, having a fixture arm 112, is connectable to the connector portions of the uprights, such as upright 25. Fixture arm 112 includes a male connector portion 114, and an arm portion 116 formed integral with, and at right angles to, male connector portion 114. Male connector portion 114 is the portion of fixture arm 112 which is adapted to be inserted into rectangular connector 40. A globular light 118 is connected pivotally to fixture arm 112. Globular light 118 is electrically connected to a conventional wall outlet.

View screen 18 is fitted, along with a shortened panel, into an upper portion of a frame 11 of the plurality of sliding it between the track portions of the uprights. View screen 118 includes a pair of edge slides 121 and 122, which engage the track portion of the uprights. View screen 18 is positioned at a selected height, immediately above hinge 28. This height is used for view screen 18, so that a projector 123 can be postioned immediately behind view screen 18 for rear projecton. Projector 123 can be set upon a carrying case 124. Carrying case 124 is adapted to carry display unit 10 when display unit 10 is disassembled. A shortened display panel 125 engages view screen 18.

Literature pouch 19 is also slideably connected to the uprights by sliding it between the track portions of the uprights. Literature pouch 19 has a plurality of pockets 127, which are adapted to receive literature, and a pair of edge slides 128 and 129, which are adapted to engage the panel tongues. Pockets 127 are of a generally rectangular configuration; and are composed of a clear plastic. Literature pouch 19 rests on a shortened display panel 130. A normal-length display panel 131 rests on literature pouch 19.

Display shelf 20 is also connected to the uprights by the plurality of shelf apertures. Display shelf 20 either extends perpendicular to the uprights or is tilted at an angle. Display shelf 20 is adapted to receive literature, or other articles to be displayed.

Frames 11 of display apparatus 10 are, in this embodiment, composed of anodized aluminum. Anodized aluminum is employed to prevent the track portions of the uprights from dirtying the display panels. Aluminum is also employed because of its light weight, and economies for shipping by air freight.

Display apparatus 10 is shipped in a knocked-down configuration in carrying case 124. Thus, all of display apparatus 10 can be conveniently shipped by air freight; and can even be transported by taxi cab to a particular exhibit or display area. Display apparatus 10, when it reaches the exhibit, is removed from carrying case 124; and the skeletal frames 11 are folded into an upright position. The skeletal frames 11 are then connected, either via their uprights directly or by hinge connectors, to form a complete display skeleton. After being thus connected, various display panels are positioned in the lower portions of skeletal frames 11. Where the literature pouch is employed, a shortened panel is positioned in the lower portion of the frame; and the literature pouch is slid on top of it. The panel stops are then positioned on top of the display panels; and the upper panels are slid into position with the panel stops. When a view screen is used, the view screen is slid into the track portions; and rests on the lower display panel. A shortened display panel is then slid into contact with the view screen. The shelves are then hung on the uprights of the various skeletal frames; and the spot lamps are connected to the uprights to illuminate the display apparatus.

When display apparatus is to be removed, the reverse procedure is used. The lamps and shelves are removed; the panels and panel stops are removed from the skeletal frames, as well as the screens and literature pouches; the frames are disassembled and folded up; and all of the apparatus is then positioned within carrying case 124, to be carried to the next exhibit.

It may therefore be appreciated that display apparatus 10 provides a lightweight convenient display apparatus. Display apparatus 10 can be conveniently transported by air, and easily set up and taken down. Display apparatus 10 is composed of aluminum, which is lightweight and does not have a tendency to deteriorate or stain display panels which are used with the display apparatus. The unique offset construction of the uprights allows the display apparatus to be set up in a variety of contours. The display panels need not be disturbed when the uprights are connected together.

Although a specific embodiment of the instant invention has been described in detail above, modification and changes of the instant invention will be obvious to one skilled in the art. It is to be expressly understood that the instant invention is limited in scope only by the appended claims.

What is claimed is:

1. A display apparatus for use in exhibitions and shows, comprising; a plurality of releasably connected display frames, each display frame of said plurality having an upper rectangular portion and a lower rectangular portion hingedly connected to the upper rectangular portions, each of said upper rectangular portions and said lower rectangular portions including a pair of parallel uprights connected to each other, each of said uprights being an extruded anodized aluminum section having a support portion, a connector portion formed integral with said support portion, and a track portion formed integral with said support portion and said connector portion, each support portion being adapted to receive a fastener extending through the support portion substantially parallel to the track portion for connecting adjacent uprights in a substantially parallel attitude, each support portion and connector portion being adapted for receiving a fastener extending through the support portion and the connector portion substantially perpendicular to the track portion and being spaced away from the track portion for connecting adjacent uprights in a substantially perpendicular attitude, a display panel slideably mounted in each of the frames between parallel uprights in the respective track portions of said uprights, a panel stop positioned between the display panels mounted on each frame to prevent an upper display panel from sliding into contact with a lower display panel; a literature pouch slideably connected to said track portions of said uprights, said literature pouch including a plurality of pockets adapted to hold literature to be distributed, a shelf adapted to be connected to a pair of side connectors of one of said frames; and a projection screen connected to one of said display frames at a height slightly above the height of a carrying container for said portable display apparatus, said projection screen being a rear projection screen and being adapted to display projected films.

* * * * *